United States Patent [19]

Gans

[11] Patent Number: 4,618,867

[45] Date of Patent: Oct. 21, 1986

[54] SCANNING BEAM ANTENNA WITH LINEAR ARRAY FEED

[75] Inventor: Michael J. Gans, Monmouth Beach Township, Monmouth County, N.J.

[73] Assignee: AT&T Bell Laboratories, Murray Hill, N.J.

[21] Appl. No.: 620,722

[22] Filed: Jun. 14, 1984

[51] Int. Cl.[4] ..... H01Q 15/16; H01Q 19/19

[52] U.S. Cl. ..... 343/781 P; 343/836; 343/840; 343/914

[58] Field of Search ..... 343/781 R, 781 P, 781 CH, 343/835, 836, 837, 840, 914

[56] References Cited

U.S. PATENT DOCUMENTS

| | | | |
|---|---|---|---|
| 4,024,543 | 5/1977 | Vokurka | 343/837 |
| 4,203,105 | 5/1980 | Dragone et al. | 343/781 P |
| 4,208,661 | 6/1980 | Vokurka | 343/781 P |
| 4,250,508 | 2/1981 | Dragone | 343/779 |
| 4,315,262 | 2/1982 | Acampora et al. | 343/100 |
| 4,339,757 | 7/1982 | Chu | 343/781 P |
| 4,343,004 | 8/1982 | Ohm | 343/781 P |
| 4,413,263 | 11/1983 | Amitay et al. | 343/756 |
| 4,503,435 | 3/1985 | Dragone | 343/781 P |
| 4,535,338 | 8/1985 | Ohm | 343/877 |

*Primary Examiner*—Eli Lieberman

*Attorney, Agent, or Firm*—Erwin W. Pfeifle

[57] ABSTRACT

The present invention relates to a scanning beam antenna comprising a doubly-curved main reflector, a doubly-curved subreflector and at least one linear array feed. The main reflector is doubly-curved in two planes to produce a separate first focus for each feed in a first plane in front of the subreflector and a separate second focus for each feed in a second orthogonal plane behind the subreflector. The subreflector is curved to refocus each second focus of the main reflector to coincide with the image line of a first axis on the reflecting surface of the main reflector in the first plane. Each feed array is disposed at a separate secondary focus of the combination of the main reflector and subreflector. The resulting antenna provides very little phase error due to aberrations as each beam is linearly scanned.

5 Claims, 2 Drawing Figures

SCANNING BEAM ANTENNA WITH LINEAR ARRAY FEED

TECHNICAL FIELD

The present invention relates to a scanning beam antenna comprising a doubly-curved main reflector, a doubly-curved subreflector and at least one linear array feed to provide a linear scanning antenna arrangement which can provide maximum capacity and efficient use of the spectrum with minimal phase error, weight and complexity.

DESCRIPTION OF THE PRIOR ART

High capacity communications satellites, and possibly other systems, require multiple scanning beams to reuse frequencies and adjust to variable traffic demands. A typical scanning beam antenna arrangement is disclosed in U.S. Pat. No. 4,203,105 issued to C. Dragone et al. on May 13, 1980. There a feed array is placed at a conjugate plane relative to the exit aperture of a geometrically confocal reflector system comprising a parabolic main reflector and a parabolic subreflector so that exact imaging of the array is obtained at the exit aperture. Such arrangement permits alignment or surface accuracy errors to be compensated for.

Antenna arrangements capable of scanning only a portion or strip of the far field of view with a linear array are also known. One linear scanning antenna arrangement is disclosed in U.S. Pat. No. 4,250,508 issued to C. Dragone on Feb. 10, 1981. There a feed arrangement comprises a separate linear phased array disposed within a separate rectangular waveguide section for each linear scanning beam desired. An offset curved reflector, disposed in each waveguide section, converts a linearly scanning planar wavefront from the array into a converging beam forming a linearly moving point source on the antenna's focal plane with the principal ray of each instantaneous wavefront being directed at the center of an image of the aperture of the optical system as seen by the feed arrangement.

Another linear scanning antenna arrangement is disclosed in U.S. Pat. No. 4,315,262 issued to A. Acampora et al. on Feb. 9, 1982. There, in FIG. 6, an array antenna is disclosed for limited scanning over multiple independent subdivisions of the total service area. More particularly, the antenna comprises a set of linear feedhorns located in the focal plane of a cylindrical parabolic reflector oriented parallel to the linear array feeds. Each row of feed elements of the array acts essentially as a line source radiating a wavefront which is transformed by the reflector into a spot beam in the far field.

Still another phased array antenna employing linear scan is disclosed in U.S. Pat. No. 4,413,263 issued to N. Amitay et al. on Nov. 1, 1983. There, a linear array of feed elements is used where the array has an aperture which is cut at a bias angle along the minor axis of the array to produce a fixed linear phase taper along the minor axis by all the elements. Then by linearly scanning the array along the major axis of the aperture of the array, a beam is scanned along an arc which is made to correspond to an orbital arc segment around a celestial body and within the field of view of the antenna when the bias angle is properly chosen.

The problem remaining in the prior art is to provide a linear or strip scanning antenna arrangement which provides less phase error and with less weight and complexity than available with conventional designs.

SUMMARY OF THE INVENTION

The foregoing problem in the prior art has been solved in accordance with the present invention which relates to a scanning beam antenna comprising a doubly-curved main reflector, a doubly-curved subreflector and at least one linear array feed to provide a linear scanning antenna arrangement which can provide maximum capacity and efficient use of the spectrum with minimal phase error, weight and complexity.

It is an aspect of the present invention to provide a linear or strip scanning antenna arrangement which comprises a linear array, a doubly-curved main reflector, and a doubly-curved subreflector. The main reflector is curved in a first plane to produce a first focal line between the main reflector and the subreflector and is curved in a second plane, orthogonal to the first plane, to produce a second focal line beyond the subreflector. The subreflector is curved in a first plane to cause a planar wavefront from the linear array feed to be focused at the first focal line of the main reflector. The subreflector is curved in a second plane, orthogonal to the first plane, to cause the focal line formed in that plane by the secondary focal points of the combination of the main and subreflector to intersect the image line of the axis on the surface of the main reflector in the first plane, where the image is formed by the subreflector curvature in the first plane. The linear feed array is then disposed on the subreflector-formed image line of the first-plane axis on the main reflector surface and located at the second-plane secondary focus of the subreflector/main reflector combination. Other and further aspects of the present invention will become apparent during the course of the following description and by reference to the accompanying drawings.

BRIEF DESCRIPTION OF THE DRAWING

Referring now to the drawings, in which like numerals represent like parts in the several views.

DETAILED DESCRIPTION

Figure 1:
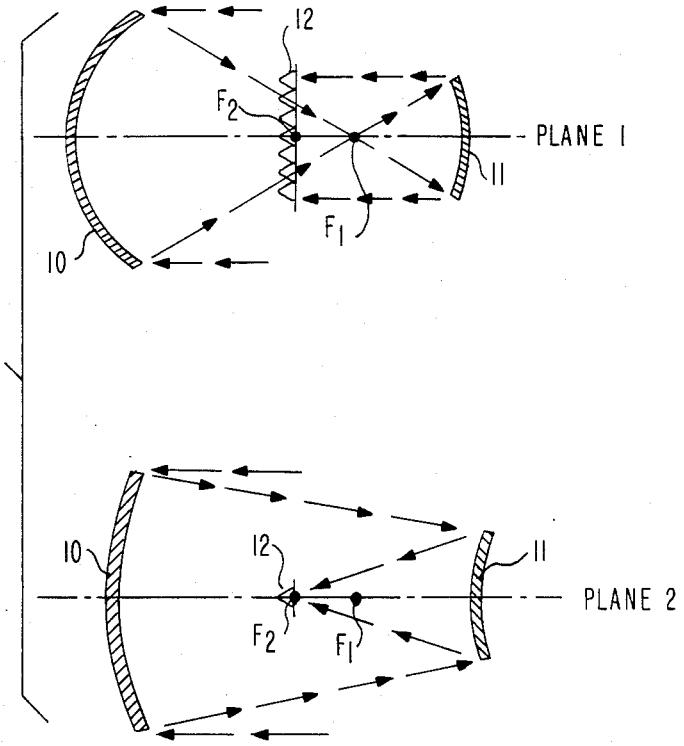
FIG. 1 is a cross-sectional view in a first and a second orthogonal plane of an "axis centered" antenna arrangement in accordance with the present invention.

FIG. 1 illustrates an exemplary antenna arrangement which is "axis centered" in two orthogonal planes in accordance with the present invention. More particularly, the arrangement is shown as comprising a doubly-curved main reflector 10, a doubly-curved subreflector 11 and a linear phased array feed 12. The curvature of main reflector 10 is such that in a first plane (designated plane 1) it produces, from a planar wavefront arriving from the far field of view, a focus $F_1$ between main reflector 10 and subreflector 11, and in a second plane (designated plane 2) it produces, from the same arriving planar wavefront, a second focus $F_2$ after the wavefront has been reflected by subreflector 11.

Subreflector 11 is curved in the first plane (plane 1) to convert the spherical wavefront, generated by the reflection of the arriving planar wavefront from main reflector 10 which passes through focus $F_1$, into a planar wavefront; and in the second plane (plane 2) to cause the second focus $F_2$ to coincide with an image line of main reflector 10 for the first plane. Linear phased array feed 12 is disposed such that its length is imaged at the main reflector, while in the orthogonal plane the feed array lies at the secondary focus of the dual reflectors 10 and 11. The reflectors 10 and 11 are chosen so that there is no phase error for a boresight beam. This design can be achieved by either chosing main reflector 10 first and then providing the appropriately doubly-curved subreflector 11 for the zero phase error boresight beam or by chosing subreflector 11 first and then providing the appropriately doubly-curved main reflector 10 for the zero phase error boresight beam.

Figure 2:
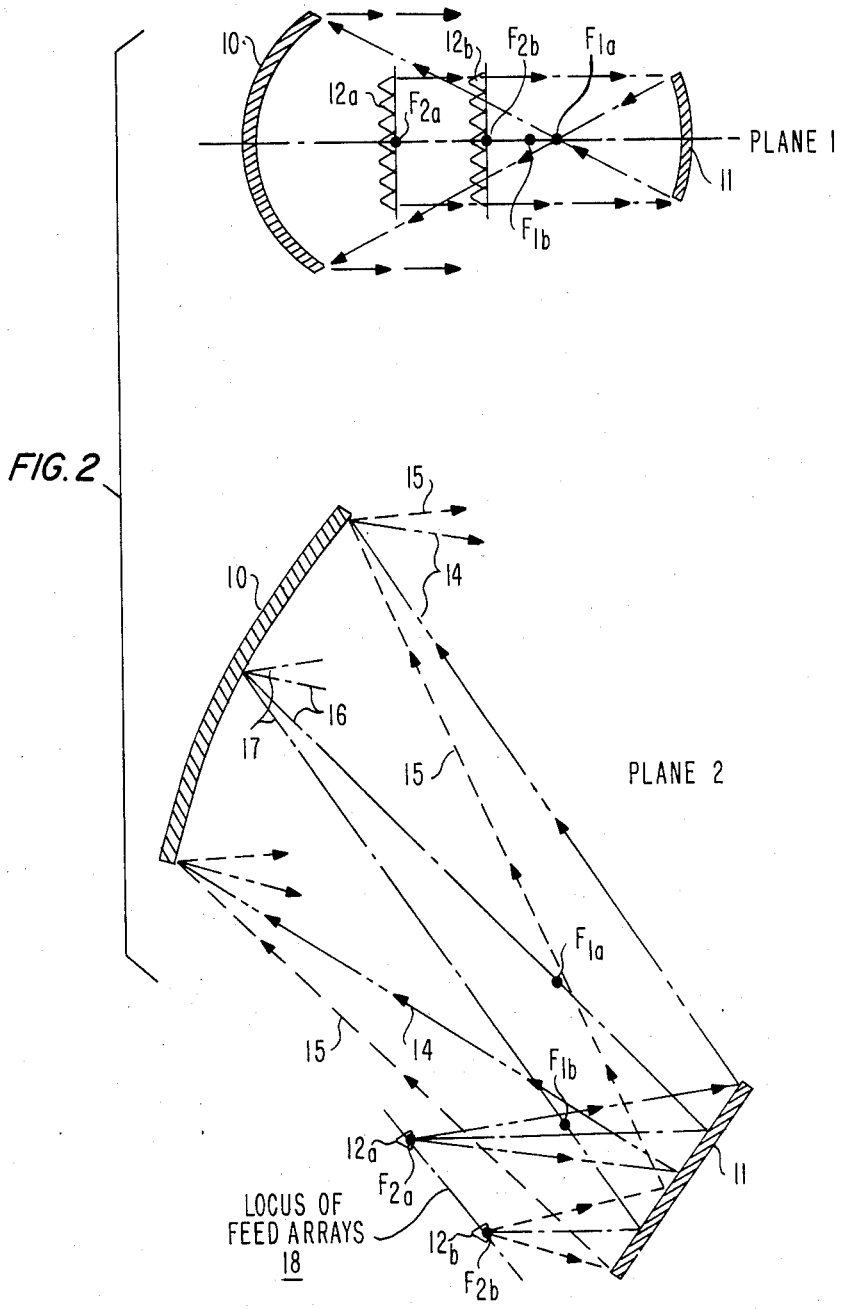
FIG. 2 is a cross-sectional view in a first and a second orthogonal plane of an exemplary offset antenna arrangement in accordance with the present invention.

FIG. 2 illustrates an example of an offset doubly-curved, dual reflector, antenna arrangement with imaging in one plane in accordance with the present invention as generally described hereinabove for the arrangement of FIG. 1. More particularly, the arrangement of FIG. 2 includes a doubly-curved main reflector 10, a doubly-curved subreflector 11 and a first and a second linear phased array feed designated $12_a$ and $12_b$, respectively. As in FIG. 1, the main reflector 10 of FIG. 2 is curved in plane 1 to produce a first focus $F_{1a}$ between main reflector 10 and subreflector 11 for a first beam 14, shown in long dashed lines, launched by a first linear phased array feed $12_a$; and to produce a first focus $F_{1b}$ between main reflector 10 and subreflector 11 for a second beam, shown in short dashed lines, launched by a second linear phased array feed $12_b$. In plane 2, orthogonal to plane 1, main reflector 10 is curved to produce a second focal point $F_{2a}$ associated with beam 14 which is disposed along a feed axis 16 of the antenna beyond subreflector 11 from main reflector 10; and to produce a second focal point $F_{2b}$ associated with beam 15 which is disposed along a feed axis 17 of the antenna beyond subreflector 11 from main reflector 10.

Subreflector 11, in FIG. 2, is shown with a cylindrical reflecting surface which is curved in plane 1 to convert a spherical wavefront passing through either one of focal points $F_{1a}$ and $F_{1b}$ into a planar wavefront upon reflection by subreflector 11. In plane 2, subreflector 11 is shown as being flat and causing the second focus points $F_{2a}$ and $F_{2b}$ to coincide with an image line of the plane 1 axis on the surface of main reflector 10. Then by disposing linear phased array feeds $12_a$ and $12_b$ at second focal points $F_{2a}$ and $F_{2b}$, respectively, the feed arrays are imaged at main reflector 10 to provide the multiple beams in accordance with the present invention. It is to be understood that additional linear phased array feeds could be disposed parallel to feed arrays $12_a$ and $12_b$ along the locus of feed arrays 18 shown in plane 2 of FIG. 2 to generate additional scanning beams.

With numerical ray tracing, it can be shown that the "axis centered" antenna shown in FIG. 1 has very little phase aberrations for beams scanned in any direction around boresight. However, aberrations are generally worse when using aperture offset in plane 1 and not as bad when using an aperture offset in plane 2 as in the case of an aperture offset in plane 1. In fact, by properly tilting subreflector 11, aberrations for scanned beams with an aperture offset in plane 2 can be made as small as for the "axis centered" arrangement. The tilt angle is chosen so the cross polarization introduced by main reflector 10 is cancelled by that introduced by subreflector 11 as described in the article "Cross Polarization In Reflector-Type Beam Waveguides and Antennas" by M. J. Gans in BSTJ, Vol. 55, No. 3, March 1976 at pages 289–316.

It is preferably that the curvature of subreflector 11 be as small as possible in plane 2 to provide minimal aberrations with scanned beams. For example, if the cross-section of subreflector 11 in plane 2 were a hyperbola, it has worse aberrations than if the cross-section of subreflector 11 were flat in that plane.

What is claimed is:

1. An antenna arrangement comprising:

a main reflector capable of bidirectionally reflecting a wavefront of electromagnetic energy along a feed axis of the antenna arrangement, the main reflector being curved along a first and second orthogonal axis on a reflecting surface of the main reflector in a first and a second orthogonal plane, respectively, to produce a first and a second focal point, respectively, at a respective separate first and a second predetermined location along the feed axis of the antenna arrangement;

a subreflector disposed on the feed axis of the antenna arrangement between the first and second focal point of the main reflector, the subreflector including a first and a second reflecting surface configuration in the first and the second orthogonal plane, respectively, to form an image line of the first axis on the surface of the main reflector, which image line intersects a secondary focal line formed by the combination of the main reflector and the subreflector in the second plane; and a linear phased array feed capable of launching or receiving a wavefront of electromagnetic energy, the feed being disposed on the image line of the first axis on the surface of the main reflector and lying in the first plane of the subreflector.

2. An antenna arrangement according to claim 1 wherein the subreflector has a cylindrical reflecting surface configuration with the flat cross-section aligned with the second plane.

3. An antenna arrangement according to claim 2 wherein the antenna arrangement further comprises:

a second linear phased array feed for launching or receiving a second separate wavefront of electromagnetic energy and disposed at a separate location in the second plane on the secondary focal line of the combination of the main reflector and subreflector and aligned with the image line of the first axis of the main reflector surface formed by the subreflector.

4. An antenna arrangement according to claim 1 wherein the subreflector has a reflecting surface configuration which is parabolic in the first plane and hyperbolic in the second plane.

5. An antenna arrangement according to claim 1 wherein the antenna arrangement further comprises:

a second linear phased array feed for launching or receiving a second separate wavefront of electromagnetic energy and disposed at a separate location in the second plane on the secondary focal line of the combination of the main reflector and subreflector and aligned with the image line of the first axis of the main reflector surface formed by the subreflector.

* * * * *